US006305784B1

(12) United States Patent
Hino

(10) Patent No.: US 6,305,784 B1
(45) Date of Patent: Oct. 23, 2001

(54) RECORDER AND METHOD OF MAKING SAME

(75) Inventor: Motohito Hino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/099,452

(22) Filed: Sep. 18, 1998

(30) Foreign Application Priority Data

Jun. 23, 1997 (JP) ..... 9-166041

(51) Int. Cl.[7] ..... B41J 2/01
(52) U.S. Cl. ..... 347/49
(58) Field of Search ..... 347/49, 50, 86, 347/87, 20, 40

(56) References Cited

U.S. PATENT DOCUMENTS 4,491,853 * 1/1985 Hayashi et al. ..... 347/200
5,148,194 * 9/1992 Asai et al. ..... 347/49
5,821,966 * 10/1998 Schell et al. ..... 347/86
6,000,784 * 12/1999 Takemoto et al. ..... 347/50

FOREIGN PATENT DOCUMENTS 9-057997 * 3/1997 (JP) .

* cited by examiner

*Primary Examiner*—N. Le
*Assistant Examiner*—Michael Nghiem
(74) *Attorney, Agent, or Firm*—Oliff & Berridge, PLC

(57) ABSTRACT

A recorder like an ink jet printer includes a head unit, which includes recording head and a head holder. Intermediate members are screwed to the holder. Each of the recording heads is bonded to one of the members and has a number of ink ejection nozzles. After the unit is assembled, one of the heads may be found to be defective. Even in this case, it is possible to remove only the defective head and the associated member, fit a new intermediate member to the holder, and bond a new recording head to the new member with the nozzles of this head aligned with the nozzles of the other heads. The intermediate member has a hole engaging with part of the head with play for positioning the head relative to the holder.

20 Claims, 10 Drawing Sheets

RECORDER AND METHOD OF MAKING SAME

BACKGROUND OF THE INVENTION

1. Field of the Invention

The present invention relates to a recorder and a method of making the recorder. In particular, the invention relates to technique for fitting a recording head to a head holder which is used for the recorder like an ink jet printer.

2. Description of Related Art

A known recorder such as an ink jet recorder for recording on a recording medium by ejecting ink onto it includes a head unit, which has recording heads and a head holder. The heads are positioned relative to the holder and fixed to it.

FIGS. 9 and 10 of the accompanying drawings show a conventional head unit 1'. The unit 1' includes a head holder 3, four recording heads 2*a*, 2*b*, 2*c* and 2*d*, a cartridge case holder 10, and a head guide 11. Each of the heads 2*a*–2*d* includes an actuator provided therein, a manifold 22 and a nozzle plate 23 which are assembled together. The heads 2*a*–2*d* are positioned relative to the holder 3, and then fixed to it. The heads 2*a*–2*d* are connected, each through an FPC (flexible printed circuit) 21, to a head board 5. The FPC 21 is soldered to the board 5, which is connected to the controller of the recorder. The manifold 22 has an ink inlet 22*a* for connection with an ink cartridge case (not shown in FIG. 9, but see in FIG. 6 as reference number 40). Seal rubbers 8*a*–8*d* are fitted to the inlets 22*a* of the heads 2*a*–2*d*, respectively, on the inside of the holder 3.

After the head unit 1' is assembled, one or more of the recording heads 2*a*–2*d* may be defective. If the heads 2*a*–2*d* are bonded to the head holder 3, it is not possible to replace only a defective recording head. A printing test may be carried out with the unit 1' fitted to the recorder. If the test reveals that even one of the heads 2*a*–2*d* is defective, it is necessary to replace the whole unit 1'. In addition, because the FPCs 21 for the heads are soldered to the head board 5, it is very difficult to tear off the FPC for the defective head and solder the FPC for the substituted head.

SUMMARY OF THE INVENTION

In view of the foregoing problems, it is an object of the invention to provide a recorder of which a defective recording head can be replaced and a substituted head can be positioned accurately with respect to the head holder, in particular, to provide a recorder with a plurality of recording heads among which only one defective recording head can be easily replaced and repositioned with respect to the head holder and the other recording heads with high positional accuracy.

It is another object of the invention to provide a method of making such a recorder.

In accordance with a first aspect of the invention, a recorder is provided for recording on a recording medium by ejecting ink onto it. The recorder includes a head holder, an intermediate member fitted removably to the holder, and a recording head fixed to the member.

After the head holder, the intermediate member and the recording head are assembled into a head unit, or after the unit is fitted to the recorder, head trouble may be found. Even in such a case, because the member can be removed from the holder, it is possible to remove the defective head together with the member, fit a new intermediate member to the holder, position a new recording head relative to the holder through the intermediate member in a certain manner described later on, and fixed the positioned head to the new member. Therefore, the holder can still be used effectively without being useless. It is possible to position the head relative to the holder simply by positioning the head relative to the member. It is therefore easier to position the head than if the head is screwed directly to the holder. It is conceivable that the heads may be fixed with screws direct to the head holder. Namely, if the heads are screwed to the holder, replacement of only a defective recording head is still possible. However, when a new recording head is substituted, it may be dislocated or displaced by the screwing torque relative to the head holder. It is therefore difficult to directly mount the heads or the substituted head onto the holder with high positional accuracy by using the screw.

The intermediate member may have such structure that the recording head can be fixed to the member while the head is positioned relative to the member. Specifically, the member may have a hole engaging with part of the head with play. This makes it possible to position the head relative to the member before the head is fixed to the member. In this case, it is easy to position the head relative to the head holder. The member may be screwed to the holder. This makes it easy to fit the member to and remove the member from the holder.

In accordance with a second aspect of the invention, another recorder is provided for recording on a recording medium by ejecting ink onto it. This recorder includes a head holder, intermediate members fitted removably to the holder, and a plurality of recording heads each fixed to one of the members.

After the head holder, the intermediate members and the recording heads are assembled into a head unit, or after the unit is fitted to the recorder, one of the heads may be found to be defective. Because the members can be removed from the holder, it is possible to remove only the defective head together with the associated member, fit a new intermediate member to the holder, position a new recording head accurately with respect to the holder and the other heads, and fix the positioned head to the new member. Therefore, even if part of the heads are defective, the other heads and the holder can still be used. Because the normal heads are positioned already, the unit can be reassembled and fitted to the recorder again in a short time. Therefore, this recorder is very effective for dot matrix type recording heads.

The recording heads may be ink jet heads. In general, the dot pitch of an ink jet recorder is very fine (in general, 0.1 or less mm). Even slight dislocation of the ink jet heads of an ink jet recorder affects the recording quality. It is therefore necessary to position the heads relative to each other with high accuracy. By using the intermediate members of the invention, it is easy to position the heads, and there is no need to position normal heads again. Therefore, the invention is very useful for ink jet recording. The ink jet heads of the invention may each include a nozzle plate, an actuator having ink chambers and a manifold having an ink inlet. The intermediate members may each have a hole engaging with the manifold of the associated head. Each of the heads may be bonded with an adhesive to the associated member. The members may be screwed to the head holder. The members may be made of the same material as the holder so that each member has the same coefficient of thermal expansion. This prevents the members from being dislocated.

The recorder according to the second aspect may also include a controller for controlling the recorder and a circuit board for driving the recording heads. The board is connected to the controller. Each of the heads may be connected to the board disconnectably through a connector. In this case, if one of the heads is defective, it can be disconnected easily from the board in order to be replaced.

In accordance with a third aspect of the invention, a method of making a recorder is provided. The recorder includes a recording head for recording on a recording medium by ejecting ink onto the medium. The head is positioned relative to a head holder and fixed to it. The method comprises the steps of:

fitting removably to the holder an intermediate member for supporting the head;

positioning the head relative to the holder; and fixing the positioned head to the member.

This recording head may include a plurality of heads. This intermediate member may include plates each associated with one of the heads. Each of the heads may be positioned relative to the head holder and then be fixed to the associated plate. In this case, even if part of the heads are defective, the other heads and the holder can still be used. Because the normal heads are positioned already, it is possible to reassemble the head unit including the heads, the members and the holder in a short time, and to fit the unit to the recorder again in a short time.

BRIEF DESCRIPTION OF THE DRAWINGS

Preferred embodiments of the invention will be described with reference to the accompanying drawings, in which.

DETAILED DESCRIPTION OF PREFERRED EMBODIMENTS

Figure 1:
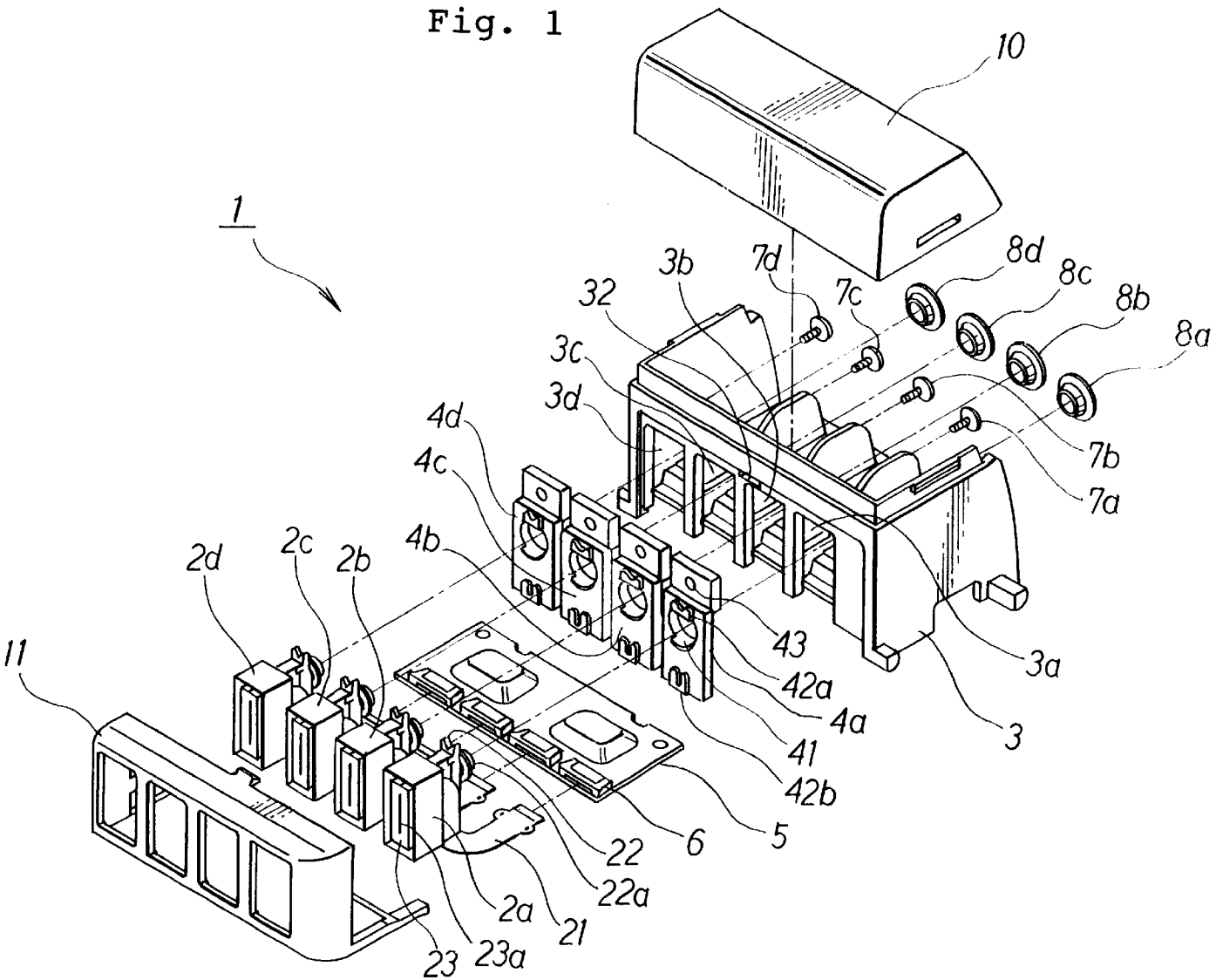
FIG. 1 is an exploded perspective view of a head unit embodying the invention.

With reference to FIG. 1, a head unit 1 according to the invention includes four recording heads 2*a*, 2*b*, 2*c* and 2*d* for ink jet color printing. Each of the heads 2*a*–2*d* is fitted with a manifold 22. The heads 2*a*–2*d* can be fixed through intermediate members 4*a*–4*d*, respectively, to a head holder 3. Each of the members 4*a*–4*d* has two holes 41 and 43, and two pairs of protrusions 42*a* and 42*b*. The head holder 3 has four openings 3*a*–3*d*.

Figure 2:
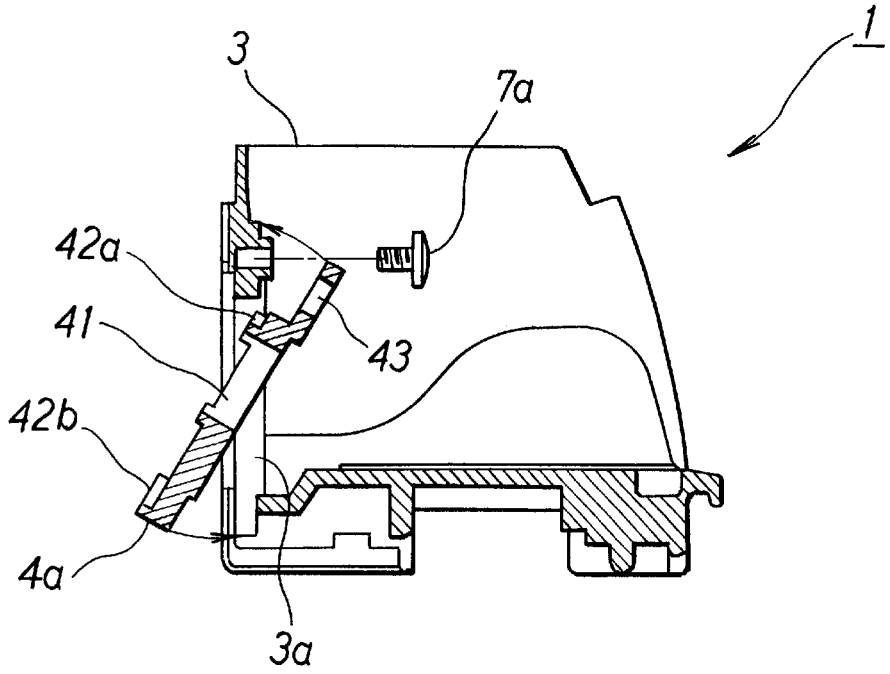
FIG. 2 is a sectional view showing how to fit an intermediate member to the head holder of the head unit.

As shown in FIG. 2, the intermediate members 4*a*–4*d* are fitted to the openings 3*a*–3*d*, respectively, and fixed to the head holder 3 with screws 7*a*–7*d*, respectively, on the inside of the holder 3. The screws 73*a*–7*d* extend through the holes 43 of the members 4*a*–4*d*, respectively. In FIG. 2, only the intermediate member 4*a* and the screw 7*a* can be seen representing the respective members 4*a*–4*d* and the respective screws 73*a*–7*d*.

Figure 3:
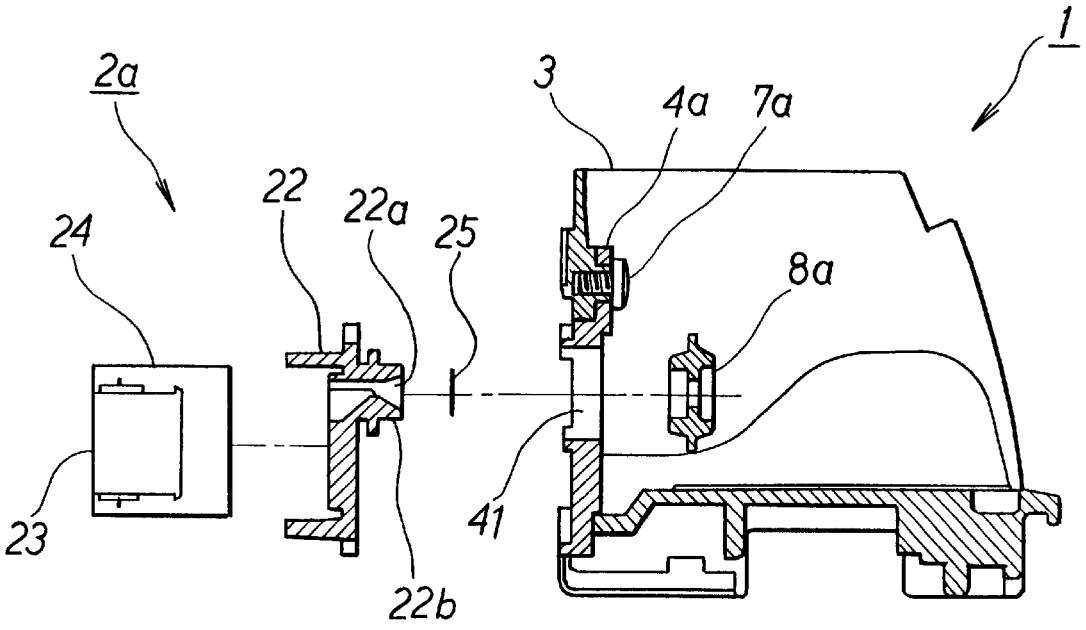
FIG. 3 is a sectional view showing how to fit a recording head etc. to the intermediate member fitted to the head holder.

Returning to FIG. 1, each of the recording heads 2*a*–2*d* includes a nozzle plate 23 having ink ejection nozzles 23*a* for dot matrix type printing. As shown in FIG. 3, each of the heads 2*a*–2*d* also includes an actuator 24 having ink chambers (not shown), to which ink can be distributed and supplied through the associated manifold 22. Each of the manifolds 22 includes a protrusion 22*b* having an ink inlet 22*a* formed through it. The outer diameter of the protrusions 22*b* is slightly smaller than the inner diameter of the holes 41 of the intermediate members 4*a*–4*d* so that the protrusions can each move in the associated hole. Each manifold 22 is fitted with a filter 25 for removing air bubbles etc. from the ink flowing into the manifold.

Figure 4:
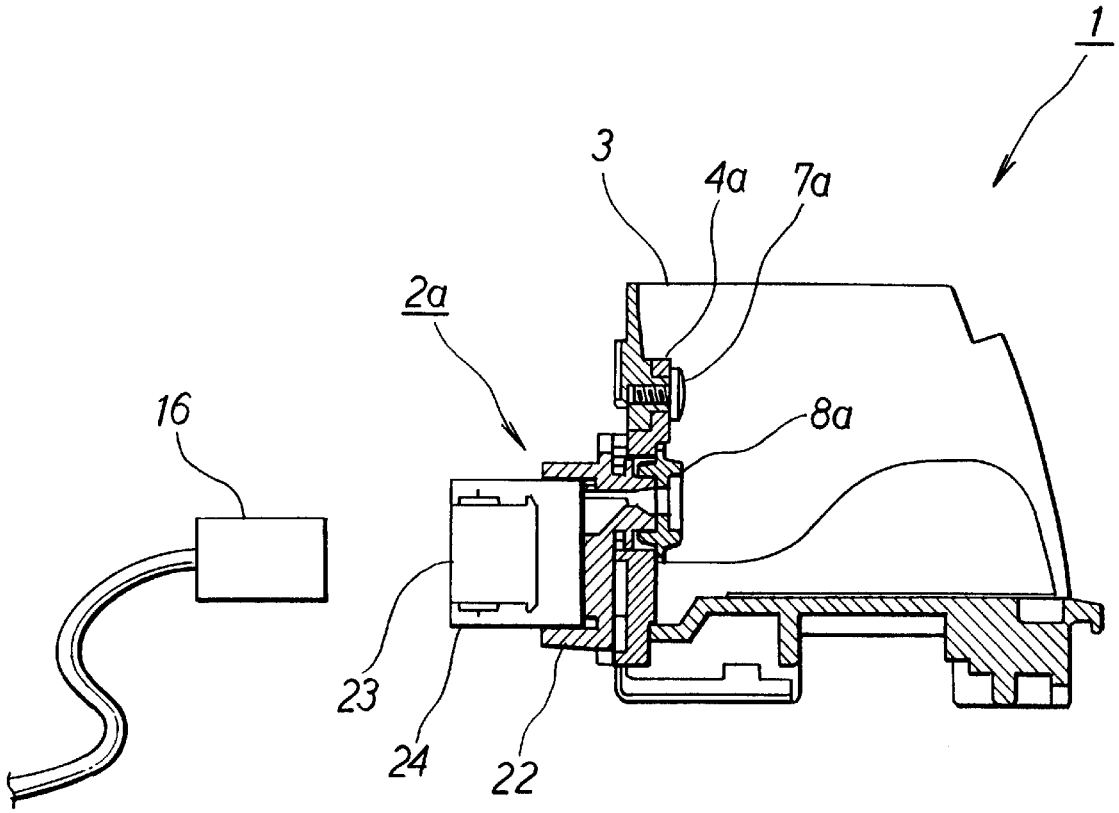
FIG. 4 is a sectional view showing how to finely position the recording head relative to the intermediate member fitted to the head holder.
Figure 8A:
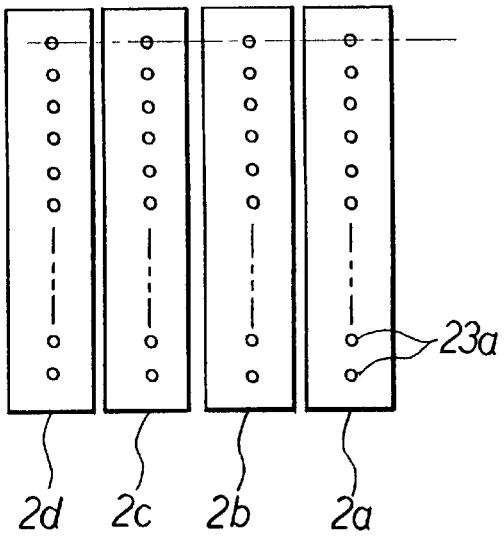
FIG. 8A is a schematic view showing the ink ejection nozzles of the recording heads.

As shown in FIG. 4, the protrusions 22*b* of the recording heads 2*a*–2*d* are inserted into the holes 41 of the intermediate members 4*a*–4*d*, respectively. The manifolds 22 are positioned roughly by the protrusions 42*a* and 42*b* of the members 4*a*–4*d*. Thereafter, the heads 2*a*–2*d* are monitored with a camera 16 positioned in front of them. While the heads 2*a*–2*d* are monitored, each of them is positioned finely with respect to the associated member 4*a*, 4*b*, 4*c* or 4*d* until their nozzles 23*a* are aligned or registered in the directions of head unit movement as shown in FIG. 8A. An adhesive or filler is poured into the gap between the manifold 22 of each of the finely positioned heads 2*a*–2*d* and the associated member 4*a*, 4*b*, 4*c* or 4*d*. This fixes the heads 2*a*–2*d* to the holder 3. Thereafter, seal rubbers 8*a*–8*d* are fitted to the inlets 22*a* of the heads 2*a*–2*d*, respectively, on the inside of the holder 3 to prevent leakage of the ink supplied from ink cartridge cases 40 (FIG. 6).

As shown in FIG. 1, a head board 5 is fixed to the bottom of the head holder 3, and includes head drivers etc. The board 5 is connected to each of the recording heads 2*a*–2*d* through an FPC (flexible printed circuit) 21, which is connected to the board 5 through a connector 6. It is therefore easy to disconnect the FPC 21 from the board 5. A cartridge case holder 10 is fitted to the top of the head holder 3 to protect the ink cartridge cases 40. A head guide 11 is fitted to the front of the head holder 3 to protect the heads 2*a*–2*d*.

Figure 5:
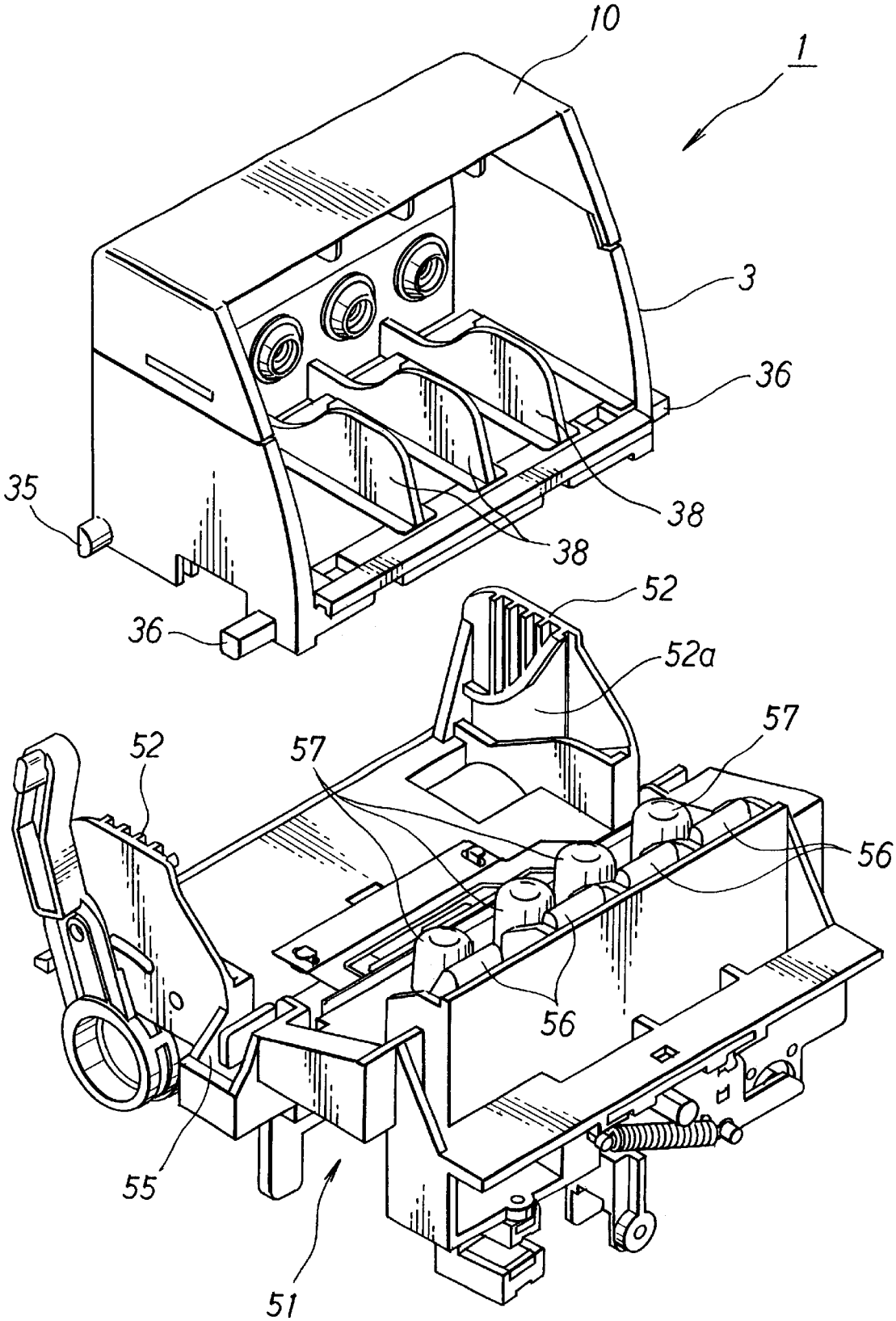
FIG. 5 is a perspective view showing the head unit and a carriage.
Figure 6:
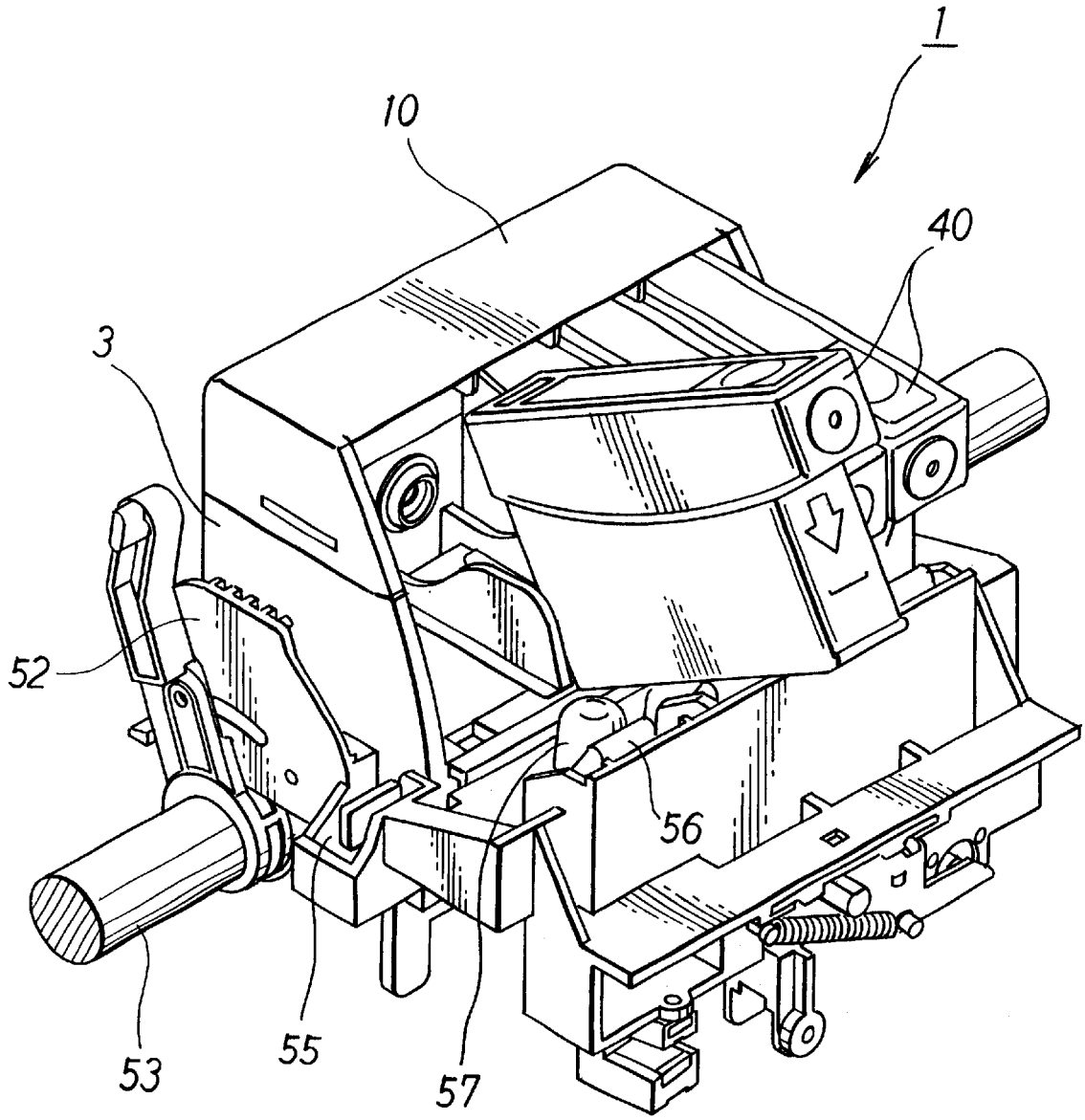
FIG. 6 is a perspective view showing how to fit ink cartridge case to the head unit mounted on the carriage.

FIGS. 5 and 6 show a printing mechanism including the head unit 1 and a carriage 51. The head unit 1 has two pairs of protrusions 35 and 36 formed on both its sides. The carriage 51 has a pair of guide grooves 52*a* formed on the inside of its side walls 52 and a pair of recesses 55 on both its sides. The unit 1 is mounted on the carriage 51. The mounting includes sliding the protrusions 35 along the grooves 52*a*, and engaging the other protrusions 36 with the recesses 55. The carriage 51 is supported on a horizontal guide shaft 53 slidably along it.

The head holder 3 has three partitions 38 in it. A space is defined between the middle partition 38 and each of the outer partitions 38. Another space is defined between each of the outer partitions 38 and the adjacent side wall of the head holder 3. As shown in FIG. 6, each of the ink cartridge cases 40, which are filled with ink, is fitted in one of the four spaces.

The carriage 51 has protrusions or holders 56 each associated with one of the recording heads 2*a*–2*d*. The carriage 51 also has detecting switches 57 each positioned near one of the protrusions 56. When the ink cartridge cases 40 are put in the head holder 3, the ink outlet (not shown) on the front end of each case 40 is fitted into the associated seal rubber 8*a*, 8*b*, 8*c* or 8*d*. Thereafter, the rear end of each cartridge case 40 is pushed down into engagement with the associated protrusion 56 in order to be fixed to the carriage 51. This presses the associated switch 57, causing the controller in the recorder to determine that the cartridge case 40 has been mounted.

Figure 7:
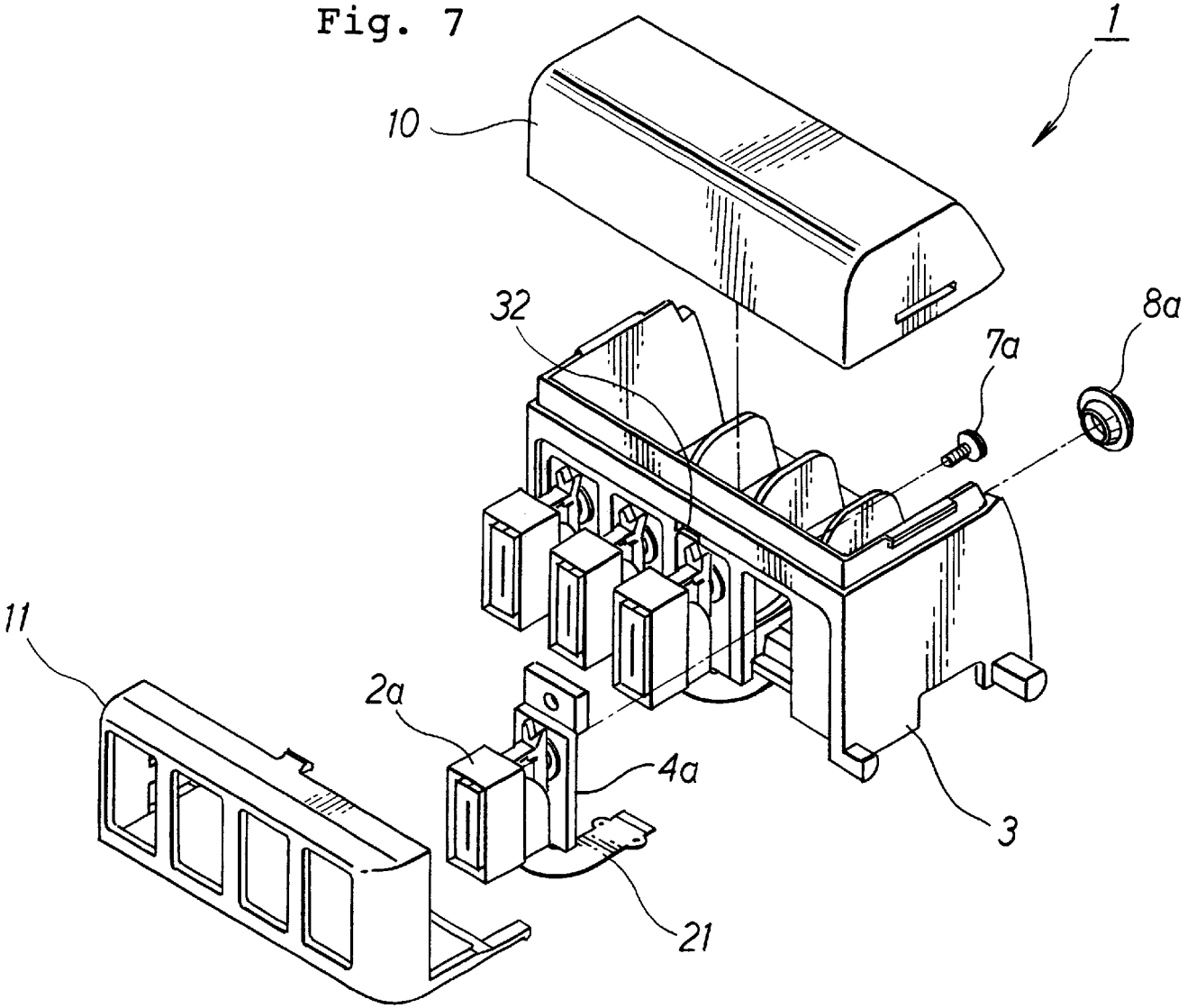
FIG. 7 is a perspective view showing how to replace one of the recording heads fitted to the head holder.

If the recording head 2*a* fitted to the head holder 3 is found to be defective, it can be replaced as shown in FIG. 7. The replacement includes:

removing the case holder 10 and the head guide 11 from the head holder 3;

removing the seal rubber 8*a* from the associated ink inlet 22*a;* unscrewing the intermediate member 4*a* to remove it together with the head 2*a* from the head holder 3;

removing the associated FPC 21 from the head board 5;

screwing a new intermediate member to the place from which the member 4*a* has been removed;

positioning a new recording head on the new member as stated above;

finely positioning the new head by using the camera (16) in front of the head unit 1 to align the ink ejection nozzles of this head with the nozzles 23*a* of the heads 2*b*–2*d;* pouring an adhesive into the gap between the new head and member to fix this head to the holder 3; and connecting the FPC of the new head to the head board 5.

In this way, the recording heads 2*a*–2*d* are bonded to the intermediate members 4*a*–4*d*, respectively, which are screwed removably to the head holder 3. Therefore, even if part of the heads 2*a*–2*d* are found defective after the head unit 1 is assembled, or after the unit 1 is fitted to the recorder, it is possible to easily replace only the defective head or heads and the associated member or members. This prevents the whole unit 1 from being defective, and makes it unnecessary to replace the whole unit. Because the heads 2*a*–2*d* are bonded to the members 4*a*–4*d*, they can be positioned accurately when fitted to the members.

The invention is not limited to the foregoing embodiment, but various modifications can be made.

The ink ejection nozzles 23*a* of the recording heads 2*a*–2*d* for different colors are aligned laterally for color print, as shown in FIG. 8A, but might be aligned otherwise.

Figure 8B:
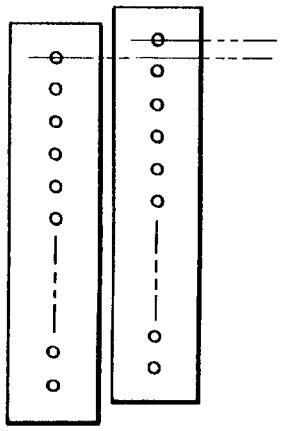
FIG. 8B is a schematic view showing the ink ejection nozzles of another head unit according to the invention.

FIG. 8B shows two recording heads for the same color. The ink ejection nozzles of one of these heads alternate with those of the other. This enables high density recording at one stroke of print.

Figure 8C:
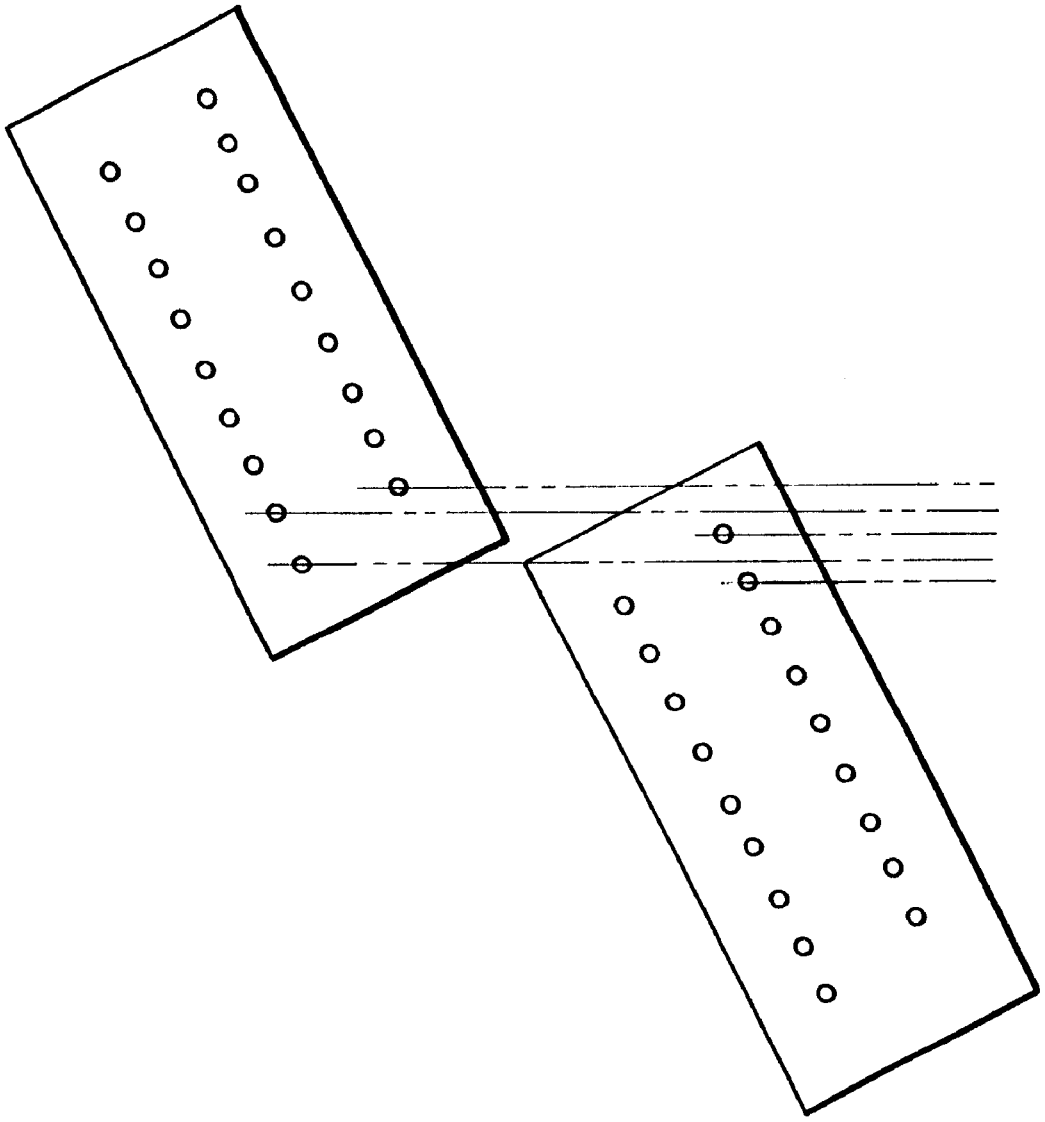
FIG. 8C is a schematic view showing the ink ejection nozzles of still another head unit according to the invention.
Figure 9:
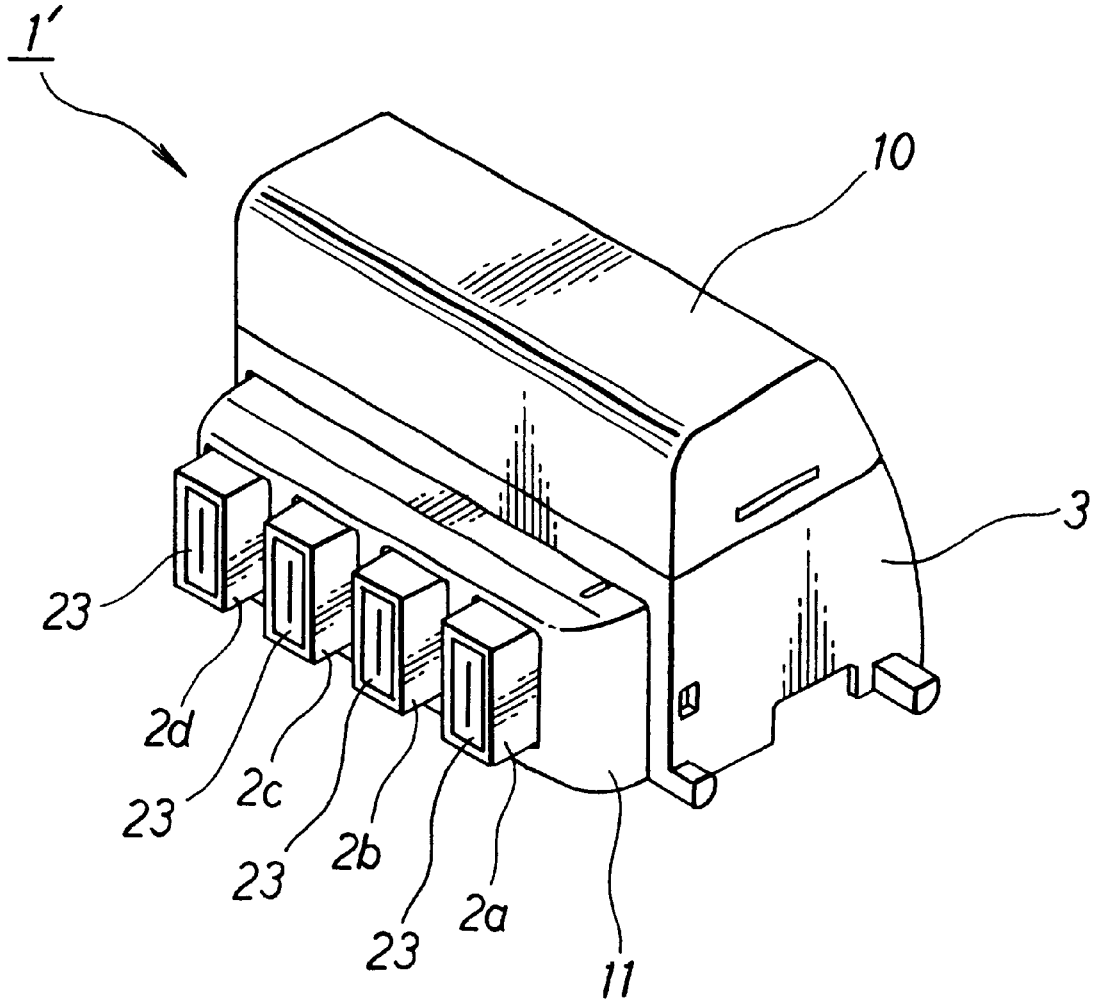
Fig. 9 PRIOR ART
FIG. 9 is a perspective view of a conventional head unit.
Figure 10:
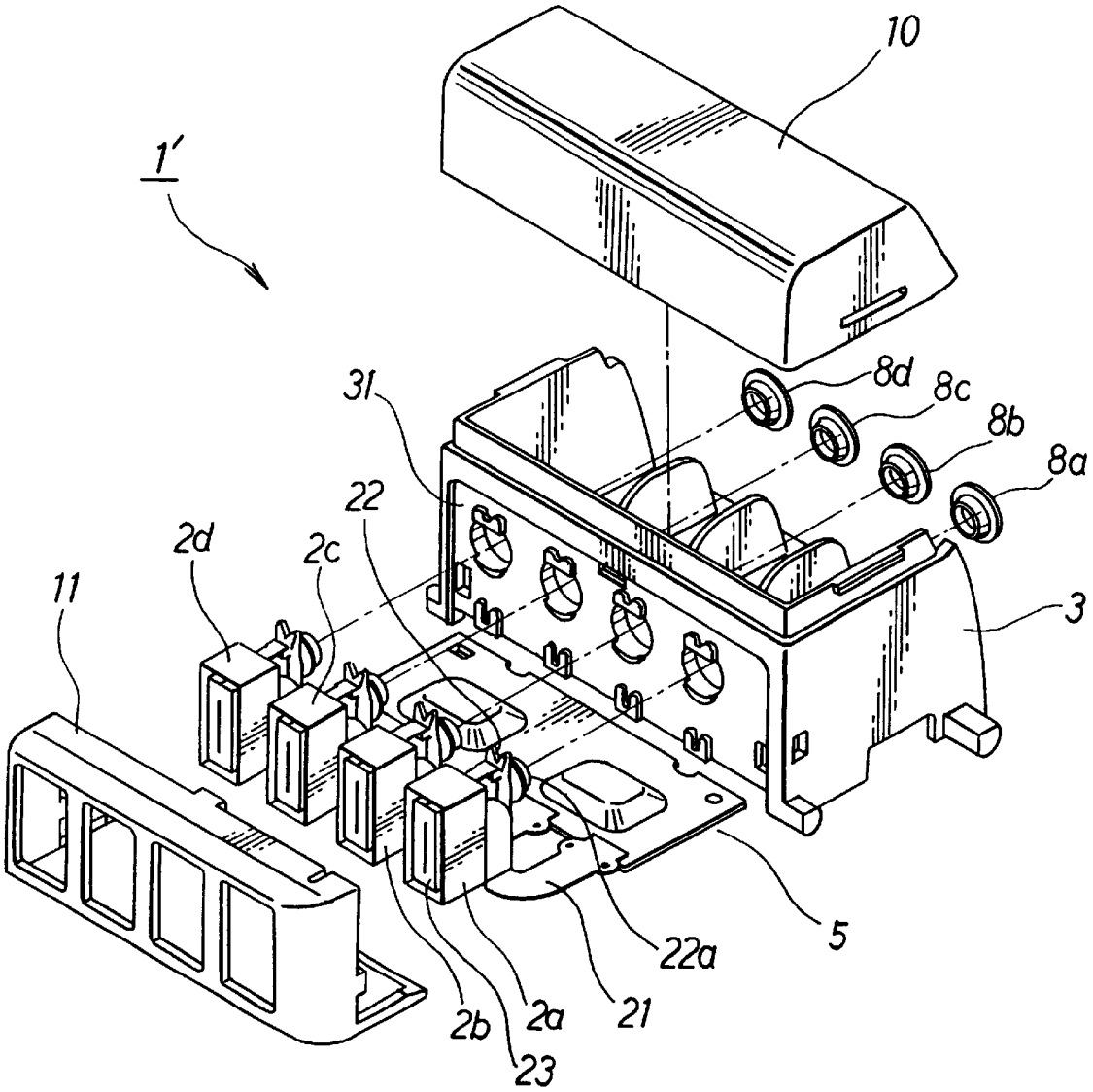
Fig. 10 PRIOR ART
FIG. 10 is an exploded perspective view of the conventional head unit.

FIG. 8C shows two recording heads each having two lines of ink ejection nozzles. These heads are displaced longitudinally from each other and inclined. If these heads were not inclined, and one of them were positioned over the other, there would be a wide space between the bottom nozzle of each line in the upper head and the top nozzle of the adjacent line in the lower head. There is no such space between the heads positioned as shown in FIG. 8C. This enables recording in the area between the heads. It is therefore possible to record in a wider area at high density.

The intermediate members 4*a*–4*d* are screwed to the head holder 3, but might otherwise be fixed to it with fittings, or heat-caulked, press-fit(ted) or shrink-fit(ted).

In general, an ink jet recorder includes recording heads each having very fine ink ejection nozzles (tens of microns in diameter). The dot pitch of the recorder is fine (in general, a pitch of 0.1 or less mm). Even slight dislocation of one or more of the heads dislocates print dots, and consequently affects the recording quality. Therefore, the invention is suitable for accurate alignment of the nozzles of the heads. In particular, the invention is very effective for an ink jet recorder including a number of recording heads for color print.

The invention can also be applied to other types of recording head, such as thermal heads for thermal recording and impact heads with wires.

What is claimed is:

1. A recorder for recording on a recording medium by ejecting ink onto the medium, the recorder comprising:

a head holder;

an intermediate member fitted removably to the head holder; and a recording head fixed to the intermediate member and removed together with the intermediate member from the head holder, wherein the intermediate member has such structure that a position of the recording head is adjustable relative to the intermediate member when the recording head is assembled into the head holder via the intermediate member.

2. The recorder as defined in claim 1, wherein the intermediate member has a hole engaging with part of the recording head so that the part of the recording head is movable within the hole, whereby the position of the recording head is adjustable relative to the intermediate member.

3. The recorder as defined in claim 2, wherein the recording head is bonded with an adhesive to the intermediate member.

4. The recorder as defined in claim 2, wherein the recording head is an ink jet head including:

a nozzle plate;

an actuator which is connected to the nozzle plate and has a plurality of ink chambers; and a manifold having an ink inlet engaging with the hole of the intermediate member.

5. The recorder as defined in claim 1, wherein the intermediate member is screwed to the head holder.

6. The recorder as defined in claim 1, wherein the intermediate member and the head holder are made of the same material.

7. The recorder as defined in claim 1, and further comprising:

a controller for controlling the recorder;

a circuit board for driving the recording head, the board being connected to the controller; and a connector interconnecting the recording head and the circuit board disconnectably.

8. A recorder for recording on a recording medium by ejecting ink onto the recording medium, the recorder comprising:

a head holder;

a plurality of intermediate members fitted removably to the head holder; and a plurality of recording heads each fixed to one of the intermediate members and each removed together with one of the intermediate members from the head holder.

9. The recorder as defined in claim 8, wherein each of the intermediate members has such structure that a position of the associated recording head is adjustable relative to each of the intermediate members when the associated recording head is assembled into the head holder via each of the intermediate members.

10. The recorder as defined in claim 8, wherein each of the intermediate members has a hole engaging with part of the associated recording head so that the part of the associated recording head is movable within the hole, whereby the position of the associated recording head is adjustable relative to each of the intermediate members.

11. The recorder as defined in claim 10, wherein each of the recording heads is bonded with an adhesive to the associated intermediate member.

12. The recorder as defined in claim 8, wherein each of the recording heads is an ink jet head including:

a nozzle plate;

an actuator which is connected to the nozzle plate and has an ink inlet engaging with the hole of the associated intermediate member.

13. The recorder as defined in claim 8, wherein the intermediate members are screwed to the head holder.

14. The recorder as defined in claim 8, wherein the intermediate members and the head holder are made of the same material.

15. The recorder as defined in claim 8, and further comprising:

a controller for controlling the recorder;

a circuit board for driving the recording heads, the circuit board being connected to the controller; and connectors each interconnecting one of the recording heads and the circuit board disconnectably.

16. The recorder as defined in claim 8, wherein, after the recorder is assembled, any of the recording heads can be removed together with the associated intermediate member or members from the head unit and replaced.

17. A method of making a recorder including a head holder and a recording head for recording on a recording medium by ejecting ink onto the recording medium, the recording head being positioned relative to and fixed to the head holder, the method comprising the steps of:

fitting removably to the head holder, an intermediate member for supporting the recording head and for removing the recording head together with the intermediate member;

positioning the recording head relative to the head holder; and fixing the positioned recording head to the intermediate member and each removed together with one of the intermediate members.

18. The method as defined in claim 17, wherein the recording head includes a plurality of heads and intermediate members each associated with one of the heads, the method further comprising the steps of:

positioning each of the heads relative to the head holder; and fixing the positioned head to the associated intermediate member.

19. The method as defined in claim 18, and further comprising the step of connecting the heads, each disconnectably through a connector, to a circuit board for driving the heads.

20. The method as defined in claim 18, wherein each of the heads is an ink jet head including at least a nozzle plate, an actuator and a manifold, each of the intermediate members having a hole, the method including the step of positioning each of the heads relative tot he head holder when the associated manifold is an engagement with the associated hole.

* * * * *

UNITED STATES PATENT AND TRADEMARK OFFICE

CERTIFICATE OF CORRECTION

PATENT NO. : 6,305,784 B1
DATED : October 23, 2001
INVENTOR(S) : Motohito Hino

It is certified that error appears in the above-identified patent and that said Letters Patent is hereby corrected as shown below:

Title page,
Item [22], should read as follows:

-- [22] Filed: June 18, 1998 --

Signed and Sealed this

Twenty-third Day of April, 2002

*Attest:*

*Attesting Officer*

JAMES E. ROGAN
*Director of the United States Patent and Trademark Office*